US008741078B2

(12) United States Patent
Song et al.

(10) Patent No.: US 8,741,078 B2
(45) Date of Patent: Jun. 3, 2014

(54) METHOD FOR MANUFACTURING AN ULTRAHIGH STRENGTH HOT DIP GALVANIZED STEEL SHEET HAVING MARTENSITIC STRUCTURE AS MATRIX

(75) Inventors: Tae-Jin Song, Pohang-si (KR); Han-Soo Kim, Pohang-si (KR); Jai-Hyun Kwak, Gwangyang-si (KR); Bruno C. De Cooman, Pohang-si (KR)

(73) Assignee: Postech Academy-Industry Foundation, Pohang (KR)

( * ) Notice: Subject to any disclaimer, the term of this patent is extended or adjusted under 35 U.S.C. 154(b) by 6 days.

(21) Appl. No.: 13/120,170

(22) PCT Filed: Sep. 23, 2009

(86) PCT No.: PCT/KR2009/005432

§ 371 (c)(1),
(2), (4) Date: Mar. 22, 2011

(87) PCT Pub. No.: WO2010/036028

PCT Pub. Date: Apr. 1, 2010

(65) Prior Publication Data

US 2011/0168301 A1 Jul. 14, 2011

(30) Foreign Application Priority Data

Sep. 23, 2008 (KR) ..... 10-2008-0093085

(51) Int. Cl.
*C23C 2/28* (2006.01)
*B32B 15/01* (2006.01)

(52) U.S. Cl.
USPC ..... 148/533; 428/659

(58) Field of Classification Search
CPC ..... C23C 2/28; B32B 15/01; C21D 2251/00
USPC ..... 148/533, 320, 333, 334; 428/659
See application file for complete search history.

(56) References Cited

U.S. PATENT DOCUMENTS

| | | | | |
|---|---|---|---|---|
| 7,294,412 | B2 | 11/2007 | Takada et al. | |
| 7,736,449 | B2 | 6/2010 | Takada et al. | |
| 2007/0190353 | A1 * | 8/2007 | Taniguchi et al. | 428/659 |

FOREIGN PATENT DOCUMENTS

| | | | |
|---|---|---|---|
| CN | 1930316 A | | 3/2007 |
| JP | 06-108152 | * | 4/1994 |
| JP | 09-025538 | | 1/1997 |

(Continued)

OTHER PUBLICATIONS

Machine-English translation of Japanese patent 2004-323951 A, Nobuhiro Fujita et al., Nov. 18, 2004.*

*Primary Examiner* — Deborah Yee
(74) *Attorney, Agent, or Firm* — Lexyoume IP Meister, PLLC

(57) ABSTRACT

The present invention relates to a hot dip galvanized steel sheet and a manufacturing method thereof. The hot dip galvanize steel sheet includes a steel sheet including a martensitic structure as a matrix, and a hot dip galvanized layer formed on the steel sheet. The steel sheet includes C of 0.05 wt % to 0.30 wt %, Mn of 0.5 wt % to 3.5 wt %, Si of 0.1 wt % to 0.8 wt %, Al of 0.01 wt % to 1.5 wt %, Cr of 0.01 wt % to 1.5 wt %, Mo of 0.01 wt % to 1.5 wt %, Ti of 0.001 wt % to 0.10 wt %, N of 5 ppm to 120 ppm, B of 3 ppm to 80 ppm, an impurity, and the remainder of Fe.

6 Claims, 19 Drawing Sheets

(56) References Cited

FOREIGN PATENT DOCUMENTS

| | | |
|---|---|---|
| JP | 10-001740 | 1/1998 |
| JP | 2005-048198 | 2/2005 |
| JP | 2006-283128 | 10/2006 |
| JP | 2009-120878 | 6/2009 |
| JP | 2009-197251 | 9/2009 |
| JP | 2010-535946 | 11/2010 |
| KR | 10-2006-0118602 | 11/2006 |
| KR | 10-0685040 | 2/2007 |
| KR | 10-0700473 | 3/2007 |
| WO | 2005/056863 | 6/2005 |

* cited by examiner

METHOD FOR MANUFACTURING AN ULTRAHIGH STRENGTH HOT DIP GALVANIZED STEEL SHEET HAVING MARTENSITIC STRUCTURE AS MATRIX

CROSS-REFERENCE TO RELATED APPLICATION

This application claims priority to and the benefit of Korean Patent Application No. 10-2008-0093085 filed in the Korean Intellectual Property Office on Sep. 23, 2008, the entire contents of which are incorporated herein by reference.

BACKGROUND OF THE INVENTION (a) Field of the Invention

The present invention relates to a hot dip galvanized steel sheet and a manufacturing method thereof. In detail, the present invention relates to a hot dip galvanized steel sheet having ultrahigh strength by using steel including a martensitic structure as a base material, and a manufacturing method thereof.

(b) Description of the Related Art

A hot dip galvanized steel sheet is inexpensive and has excellent corrosion resistance, so it is widely used for exterior parts of vehicles. A component of the vehicle such as a side impact beam uses the hot dip galvanized steel sheet since it requires corrosion resistance while maintaining strength against an impact provided from the outside. The strength of the hot dip galvanized steel sheet needs to be increased so as to protect vehicle occupants from accidents while making the vehicle light in weight.

Usage of the high strength steel for the vehicle and its occupants has recently increased because of an increase in demands regarding environment regulations, stability, and fuel efficiency. The high strength steel is generally used in two ways. The high strength steel is used to absorb an impact and disperse the force of the impact when a vehicle is in an accident. Dual phase (DP) steel and transformation induced plasticity (TRIP) steel have excellent toughness to absorb the impact under the condition of a head-on collision. However, the above-noted steels do not have sufficient strength to protect the occupants from a broadside collision or overturning. Therefore, in order to disperse the strong impact force without transformation, a material with excellent yield strength and tensile strength is needed.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a hot dip galvanized steel sheet that is stronger than a dual phase steel and a transformation induced plasticity steel by using a steel sheet with a martensitic structure that is not tempered as a matrix.

The present invention has been made in another effort to provide a method for manufacturing a hot dip galvanized steel sheet.

An exemplary embodiment of the present invention provides a hot dip galvanized steel sheet including a steel sheet including a martensitic structure as a matrix, and a hot dip galvanized layer formed on the steel sheet. The steel sheet includes C of 0.05 wt % to 0.30 wt %, Mn of 0.5 wt % to 3.5 wt %, Si of 0.1 wt % to 0.8 wt %, Al of 0.01 wt % to 1.5 wt %, Cr of 0.01 wt % to 1.5 wt %, Mo of 0.01 wt % to 1.5 wt %, Ti of 0.001 wt % to 0.10 wt %, N of 5 ppm to 120 ppm, B of 3 ppm to 80 ppm, an impurity, and the remainder of Fe.

An amount of C is 0.05 wt % to 0.20 wt %, an amount of Ti is 0.001 wt % to 0.05 wt %, an amount of N is 20 ppm to 80 ppm, and an amount of B is 5 ppm to 50 ppm. An amount of C is substantially 0.15 wt %, an amount of Mn is substantially 2.0 wt %, an amount of Si is substantially 0.3 wt %, an amount of Al is substantially 0.03 wt %, an amount of Cr is substantially 0.3 wt %, an amount of Mo is substantially 0.3 wt %, and an amount of B is substantially 29 ppm. The N, Ti and B satisfy the subsequent equation: $B(ppm) \geq 0.8 \times (N(ppm) - Ti(ppm)/2.9) + 5$.

A content of a martensitic structure of the steel sheet is greater than 60 vol % and less than 100 vol %. The steel sheet further includes a bainite structure, and the content of the bainite structure is greater than 0 vol % and less than 40 vol %. The hot dip galvanized layer includes Fe.

Another embodiment of the present invention provides a method for manufacturing a hot dip galvanized steel sheet including: providing a steel sheet including C of 0.05 wt % to 0.30 wt %, Mn of 0.5 wt % to 3.5 wt %, Si of 0.1 wt % to 0.8 wt %, Al of 0.01 wt % to 1.5 wt %, Cr of 0.01 wt % to 1.5 wt %, Mo of 0.01 wt % to 1.5 wt %, Ti of 0.001 wt % to 0.10 wt %, N of 5 ppm to 120 ppm, B of 3 ppm to 80 ppm, an impurity, and the remainder of Fe; maintaining the temperature of the steel sheet at 750° C. to 950° C. by heating the steel sheet; dipping the heated steel sheet into a hot dip galvanizing bath to hot dip galvanize it; and quenching the annealed hot dip galvanized steel sheet at a quenching rate of 10° C./s to 100° C./s to martensite transform the steel sheet.

In the providing of a steel sheet, an amount of C is 0.05 wt % to 0.20 wt %, an amount of Ti is 0.001 wt % to 0.05 wt %, an amount of N is 20 ppm to 80 ppm, and an amount of B is 5 ppm to 50 ppm. In the maintaining of a temperature of the steel sheet, the temperature of the steel sheet is maintained at 780° C. to 950° C. In the martensite transformation of the steel sheet, a quenching rate of the annealed hot dip galvanized steel sheet is 10° C./s to 60° C./s.

In the providing of a steel sheet, an amount of C is substantially 0.15 wt %, an amount of Mn is substantially 2.0 wt %, an amount of Si is substantially 0.3 wt %, an amount of Al is substantially 0.03 wt %, an amount of Cr is substantially 0.3 wt %, an amount of Mo is substantially 0.3 wt %, and an amount of B is substantially 29 ppm. In the providing of a steel sheet, the N, Ti, and B satisfy the subsequent equation: $B(ppm) \geq 0.8 \times (N(ppm) - Ti(ppm)/2.9) + 5$.

In the maintaining of a temperature of the steel sheet, the steel sheet is austenite transformed. In the martensite transforming of the steel sheet, the cooling rate is 10° C./s to 40° C./s. The cooling rate is 20° C./s to 40° C./s.

In the hot dip galvanizing the heated steel sheet, the hot dip galvanizing bath includes Fe. The method further includes hot dip galvanizing the heated steel sheet and annealing the steel sheet.

According to the embodiments of the present invention, a hot dip galvanized steel sheet with excellent strength that is greater than 1.2 GPa and with excellent corrosion resistance can be manufactured by using a steel sheet with a martensitic structure that is not tempered as a matrix. Therefore, the above-described hot dip galvanized steel sheet is used for outer components of a vehicle to improve the strength of the outer components thereof and protect the occupants from traffic accidents. Further, the vehicle can be made lighter by using the hot dip galvanized steel sheet with excellent strength.

DETAILED DESCRIPTION OF THE EMBODIMENTS

Figure 1:
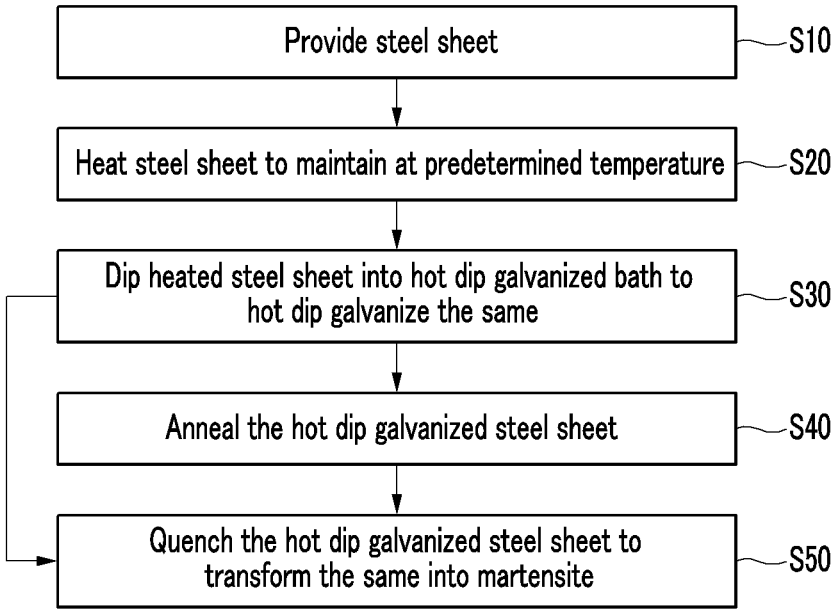
FIG. 1 schematically shows a flowchart of a method for manufacturing a hot dip galvanized steel sheet according to an exemplary embodiment of the present invention.

It will be understood that when an element is referred to as being "on" another element, it can be directly on another element or intervening elements may be present therebetween. In contrast, when an element is referred to as being "directly on" another element, there are no intervening elements therebetween.

The technical terms used herein are to simply mention a particular exemplary embodiment and are not meant to limit the present invention. An expression used in the singular encompasses the expression of the plural, unless it has a clearly different meaning in the context. In the present invention, it is to be understood that the terms such as "including" or "having," etc., are intended to indicate the existence of the specific features, regions, numbers, stages, operations, elements, components, or combinations thereof disclosed in the specification, and are not intended to preclude the possibility that one or more other specific features, regions, numbers, operations, elements, components, or combinations thereof may exist or may be added.

Spatially relative terms, such as "below" and "above" and the like may be used herein for ease of description to describe one element or feature's relationship to another element(s) or feature(s) as illustrated in the figures. It will be understood that spatially relative terms are intended to encompass different orientations of the device in use or operation in addition to the orientation depicted in the drawings. For example, if the device in the figures is turned over, elements described as "below" other elements or features would then be oriented "above" the other elements or features. Thus, the exemplary term "below" can encompass both an orientation of above and below. Apparatuses may be otherwise rotated 90 degrees or by other angles, and the spatially relative descriptors used herein are then interpreted accordingly.

The term "hot dip galvanize" used in the specification represents a process for melting zinc or an alloy including zinc and plating the steel sheet with it. Therefore, the steel sheet can be plated by only melting zinc or by melting an alloy including iron and other elements in addition to zinc.

Unless otherwise defined, all terms used herein, including technical or scientific terms, have the same meanings as those generally understood by those with ordinary knowledge in the field of art to which the present invention belongs. Such terms as those defined in a generally used dictionary are to be interpreted to have the meanings equal to the contextual meanings in the relevant field of art, and are not to be interpreted to have idealized or excessively formal meanings unless clearly defined in the present application.

FIG. 1 schematically shows a flowchart of a method for manufacturing a hot dip galvanized steel sheet according to an exemplary embodiment of the present invention. The method for manufacturing a hot dip galvanized steel sheet shown in FIG. 1 only exemplifies the present invention, and the present invention is not restricted thereto. Hence, the hot dip galvanized steel sheet can be manufactured by using other methods.

As shown in FIG. 1, the method for manufacturing a hot dip galvanized steel sheet includes: providing a steel sheet (S10); heating the steel sheet to be maintained at a predetermined temperature (S20); dipping the heated steel sheet into a hot dip galvanizing bath to hot dip galvanize it (S30); annealing the hot dip galvanized steel sheet (S40); and quenching hot dip galvanized steel sheet to transform the steel sheet into martensite (S50). The above-noted process is applicable to the case of manufacturing a galvanized annealed (GA) steel sheet, and the alloyed hot dip galvanized layer is formed on a steel sheet surface. On the contrary, the process for performing the stage of S50 without performing the stage of S40 for annealing the hot dip galvanized steel sheet corresponds to the case of manufacturing the galvanized steel (GI) sheet. In this case, the hot dip galvanized layer is formed on the steel sheet surface.

The stage S10 for providing a steel sheet includes providing a steel sheet including C of 0.05 wt % to 0.30 wt %, Mn of 0.5 wt % to 3.5 wt %, Si of 0.1 wt % to 0.8 wt %, Al of 0.01 wt % to 1.5 wt %, Cr of 0.01 wt % to 1.5 wt %, Mo of 0.01 wt % to 1.5 wt %, Ti of 0.001 wt % to 0.10 wt %, N of 5 ppm to 120 ppm, B of 3 ppm to 80 ppm, an impurity, and remaining Fe. The steel sheet includes the described composition so when the steel sheet is quenched after it is hot dip galvanized, the steel sheet can be martensitically transformed. The steel sheet includes a martensitic structure as a matrix.

The steel sheet includes carbon C of 0.05 wt % to 0.30 wt %. Desirably, the amount of carbon C can be 0.05 wt % to 0.20 wt %. The carbon (C) is effective in making the steel sheet be highly strengthened, and stabilizes an austenite structure. The carbon (C) stabilizes the austenite structure included in the steel sheet to hot dip galvanize the steel sheet, quench the same, and thereby perform martensite transformation. When there is a large amount of carbon (C), the welding property is deteriorated and it may generate a problem when it is used as a steel material for a vehicle. Further, when there is very little carbon (C), it is difficult to acquire the steel material with high strength. When there is a very small amount of carbon (C), it is inappropriate for the process since the temperature for making the steel sheet into austenite is increased. Desirably, the amount of carbon (C) can be substantially 0.15 wt %.

Also, the steel sheet includes manganese (Mn) of 0.5 wt % to 3.5 wt %. The manganese (Mn) stabilizes the austenite phase to control generation of a ferrite phase or bainite phase when the steel sheet is cooled, dipped, or annealed. Further, the manganese (Mn) increases strength of the steel material according to the solid solution hardening effect. When there is a very large amount of manganese (Mn), oxidization resistance of the steel sheet is deteriorated in the heat treatment process at a high temperature. When there is a very small amount of manganese (Mn), the strength of the steel sheet is deteriorated. Desirably, the amount of manganese (Mn) can be substantially 2.0 wt %.

The steel sheet includes silicon (Si) of 0.1 wt % to 0.8 wt %. When there is a very large amount of silicon (Si), a surface oxide is generated when the steel sheet is heat treated at a high temperature to deteriorate wetness in the dipping process. Also, when there is a very small amount of silicon (Si), flexibility of the steel material is deteriorated by generation of carbide. Desirably, the amount of silicon (Si) can be substantially 0.3 wt %.

Further, the steel sheet includes aluminum (Al) of 0.01 wt % to 1.5 wt %. When it includes aluminum (Al), the nitrogen (N) forms AlN, a precipitation that is more stable than BN to increase the concentration of effective boron. The aluminum (Al) is also used as a deoxidizer. Therefore, when the remainder of aluminum (Al) is less than 0.01 wt %, it is undesirable in the economical viewpoint. When there is a very large amount of aluminum (Al), it forms an oxide to deteriorate wetness. Desirably, the amount of aluminum (Al) is 0.03 wt %.

The amount of chromium (Cr) included in the steel sheet is 0.01 wt % to 1.5 wt %. The chromium (Cr) controls bainite nucleation and is effective for highly strengthening the steel sheet. When there is a very large amount of chromium (Cr), no substantial effect is obtained. When there is a very large amount of chromium (Cr), the proccessability or the plating property is deteriorated. Desirably, the amount of chromium (Cr) can be substantially 0.3 wt %.

Also, the steel sheet includes molybdenum (Mo) of 0.01 wt % to 1.5 wt %. The molybdenum (Mo) increases the boron adding effect and makes the steel sheet more highly strengthened. When there is a very small amount of molybdenum (Mo), no substantial hardening effect is acquired. Further, when there is a very large amount of molybdenum (Mo), the proccessability is deteriorated and it is undesirable in the economic manner. Desirably, the amount of molybdenum (Mo) can be substantially 0.3 wt %.

The steel sheet includes titanium (Ti) of 0.001 wt % to 0.10 wt. Desirably, the amount of titanium (Ti) can be 0.001 wt % to 0.05 wt. The titanium is combined with nitrogen remaining in the steel material to form a TiN precipitation. As a result, the titanium increases the concentration of the effective boron. When there is a very large amount of titanium, the re-crystallization temperature is increased to generate much surface enrichment of Si, Mn, and B according to an increase of the annealing temperature surface, and deteriorates wetness. When there is a very small amount of titanium, the effective concentration of boron (B) is reduced by nitrogen (N). However, when the concentration of boron (B) exceeds 200 ppm, the titanium may not be included in the steel sheet.

The steel sheet includes nitrogen (N) of 5 ppm to 120 ppm. Desirably, the amount of nitrogen (N) can be 20 ppm to 80 ppm. When there is a very small amount of nitrogen (N), the process is impossible. Also, when there is a very large amount of nitrogen (N), the BN precipitation is formed to reduce the concentration of the effective boron.

The steel sheet includes boron (B) of 3 ppm to 80 ppm. Desirably, the amount of boron (B) can be 5 ppm to 50 ppm. The boron (B) is densified on the austenite grain boundary to thus suppress ferrite or bainite nucleation on the grain boundary. As a result, the boron (B) increases the fraction of the martensite of the steel sheet. When there is a very small amount of boron, the above-described effect cannot be acquired. Also, when there is a very large amount of boron, cracks may occur because of the concentration on the surface during the cold rolling process.

The nitrogen (N), titanium (Ti), and boron (B) satisfy Equation 1.

$$B(ppm) \geq 0.8 \times (N(ppm) - Ti(ppm)/2.9) + 5 \quad \text{[Equation 1]}$$

When the content of boron included in the steel material is less than the right term of Equation 1, the strength improving effect of the steel sheet caused by addition of boron cannot be expected. Therefore, transformation from the austenite to the bainite is inefficient. When the content of Ti is large and the value in the parentheses becomes less than 0 in Equation 1, the residual Ti does not influence the distribution of B. Hence, Ti does not deteriorate the property of the steel sheet. The residual Ti forms a precipitation with C so it can expect the precipitation hardening effect.

When the amount of C is greater than 0.12 wt %, C, Mn, Si, Cr, and Mo simultaneously satisfy Equations 2 and 3. When the composition of the steel sheet is input into the right term of Equation 2 and the corresponding value is less than 200, the steel sheet cannot have sufficient strength when it is martensite transformed. When the composition of the steel sheet is input into the left term of Equation 3 and the corresponding value is greater than 800, the welding property of the steel sheet is deteriorated.

$$200 < 803 \times C(wt\%) + 83 \times Mn(wt\%) + 178 \times Si(wt\%) + 122 \times Cr(wt\%) + 320 \times Mo(wt\%) \quad \text{[Equation 2]}$$

$$803 \times C(wt\%) + 134 \times Mn(wt\%) + 134 \times Si(wt\%) + 160 \times Cr(wt\%) + 160 \times Mo(wt\%) < 800 \quad \text{[Equation 3]}$$

Therefore, the composition of the steel sheet is maintained within the above-described range. As a result, the hot dip galvanized steel sheet that is martensite transformed to have ultrahigh strength can be manufactured.

In the stage S20, the steel sheet is heated to be maintained at a predetermined temperature to transform the steel sheet into austenite. When the steel sheet is heated at a regular heating speed, the temperature of the steel sheet is maintained at 750° C. to 950° C. Desirably, the temperature of the steel sheet is maintained at 780° C. to 950° C. When the temperature for heating the steel sheet and maintaining it is very low, the ferrite fraction within the steel sheet is increased to increase the amount of the bainite that is generated when it is dipped into the electroplating solution or alloyed. Also, when the temperature for heating the steel sheet and maintaining it is very high, the amount of densified Si, Mn, and B on the surface is increased to deteriorate wetness when dipping into the electroplating solution and much production cost is consumed. Therefore, the temperature for heating the steel sheet and maintaining it is within the described range.

In the stage S30, the heated steel sheet is dipped into the hot dip galvanizing bath to hot dip galvanize the steel sheet. Therefore, the melted zinc is coated on the surface of the steel sheet and a hot dip galvanized steel sheet is accordingly manufactured. Here, the hot dip galvanizing bath can be heated at a temperature of 430° C. to 490° C. By controlling the temperature of the hot dip galvanizing bath within the range, the hot dip galvanization is fluently and efficiently performed.

In the stage S40, the hot dip galvanized steel sheet is annealed to alloy the hot dip galvanized layer. Therefore, since the hot dip galvanizing bath includes Fe, a Zn—Fe alloy is formed. This process corresponds to the case of manufacturing a galvanized annealed (GA) steel sheet. Here, the annealing temperature of the steel sheet can be 480° C. to 520° C. When the annealing temperature is very low, the alloying time is increased to deteriorate productivity. Also, when the annealing temperature is very high, the gamma phase of the hot dip galvanized layer is formed to be thick so its powdered state is deteriorated.

When a galvanized steel (GI) sheet is manufactured, the steel sheet is not annealed. Therefore, the hot dip galvanized steel sheet requiring no alloying process undergoes the stage S30 and then goes to the stage S50 without performing the stage S40.

In the stage S50, the hot dip galvanized steel sheet is quenched to martensite transform the steel sheet. Here, the quenching speed of the hot dip galvanized steel sheet can be 10° C./s to 60° C./s. When the quenching speed of the hot dip galvanized steel sheet is very slow, bainite is generated while the steel sheet is cooled thereby reducing the fraction of the martensite. Further, when the quenching speed of the hot dip galvanized steel sheet is very high, much energy is used during the quenching process, which is inappropriate. Desirably, the quenching speed of the hot dip galvanized steel sheet can be 10° C./s to 40° C./s. Further desirably, the quenching speed of the hot dip galvanized steel sheet can be 20° C./s to 40° C./s.

The content of the martensitic structure of the quenched steel sheet can be greater than 60 vol % and less than 100 vol %. When the content of the martensitic structure is very much less, the hot dip galvanized steel sheet is unfit for a vehicle's outer component requiring high strength. Also, the steel sheet can include bainite in addition to martensite. The amount of bainite included in the quenched steel sheet is greater than 0 and less than 40 vol %. The bainite is generated from the steel sheet through heat treatment while the austenite transformed steel sheet is hot dip galvanized. Since the quenched steel sheet includes martensite and bainite, it has excellent strength.

Figure 2:
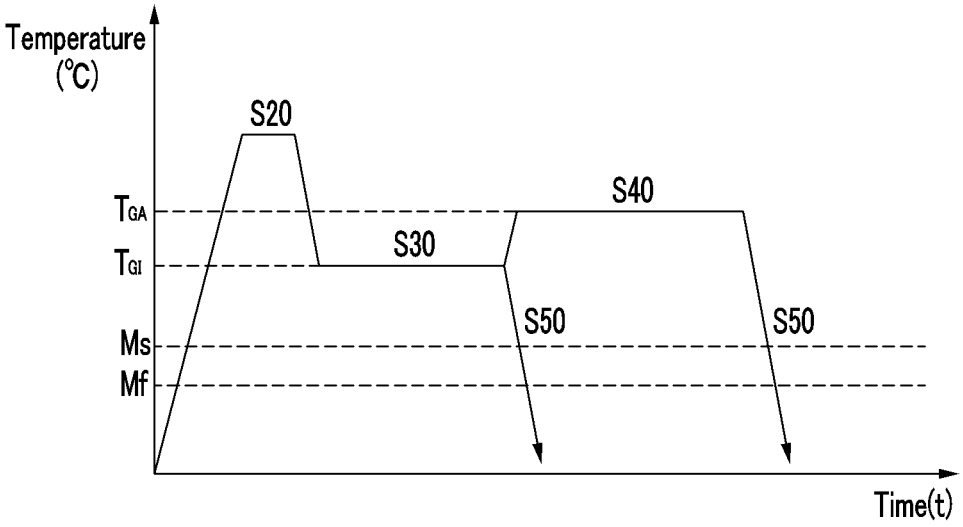
FIG. 2 is a graph for sequentially showing a method for manufacturing a hot dip galvanized steel sheet of FIG. 1.

FIG. 2 is a graph for sequentially showing a method for manufacturing a hot dip galvanized steel sheet of FIG. 1. The graph of FIG. 2 is given only to exemplify the embodiment of the present invention, and the embodiment of the present invention is not restricted thereto. Therefore, the graph of FIG. 2 is variable in many ways.

FIG. 2 shows a process for heating a steel sheet and a process for cooling the steel sheet according to the respective stages of S20, S30, S40, and S50 in FIG. 1. That is, the stage S20 includes heating the steel sheet to perform austenite transformation, and the stage S30 includes dipping the heated steel sheet into the hot dip galvanizing bath to hot dip galvanize it. The hot dip galvanizing temperature ($T_{GI}$) of S30 is lower than the austenite transformation temperature of S20.

In the stage S40, the hot dip galvanized steel sheet is annealed at the temperature ($T_{GA}$). The annealing temperature ($T_{GA}$) of S40 is somewhat greater than the hot dip galvanizing temperature ($T_{GI}$) of S30. Bainite can be formed on a part of the steel sheet structure when the steel sheet undergoes the stages S30 and S40.

In the stage S50, the hot dip galvanized steel sheet is quenched to reduce the temperature of the hot dip galvanized steel sheet to be less than a martensite transformation starting temperature (Ms) and a martensite finish temperature (Mf). Therefore, the steel sheet is martensite transformed. When a GI sheet is manufactured, the stage S50 is performed without performing the stage of S40 after performing the stage S30. When a GA sheet is manufactured, the stages S30, S40, and S50 are performed. Through the above-described stages, the hot dip galvanized steel sheet can be martensite transformed.

Figure 3:
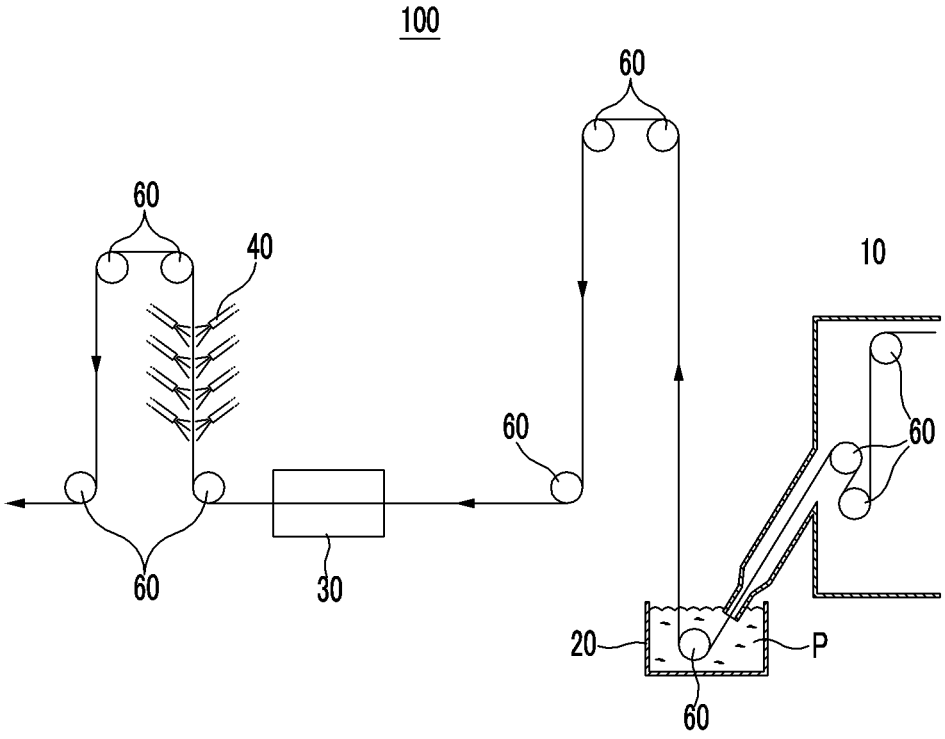
FIG. 3 schematically shows a device for manufacturing a hot dip galvanized steel sheet according to an exemplary embodiment of the present invention.

FIG. 3 shows a hot dip galvanizing device 100 for manufacturing the hot dip galvanized steel sheet. The hot dip galvanizing device 100 shown in FIG. 3 exemplifies the embodiment of the present invention, but the embodiment of the present invention is not restricted thereto. Therefore, the hot dip galvanizing device 100 can be varied in many ways.

As shown in FIG. 3, the hot dip galvanizing device 100 include a furnace 10, a hot dip galvanizing bath 20, an annealing furnace 30, and a gas injector 40. The steel sheet moves from to the right to the left in the arrow direction by a plurality of transfer rolls 60 to be made into a hot dip galvanized steel sheet and then be output.

As shown in FIG. 3, the furnace 10 heats the steel sheet to transform into austenite. The steel sheet drawn out of the furnace 10 is dipped into the hot dip galvanizing bath 20 and is then galvanized. The electroplating solution (P) dissolved in the hot dip galvanizing bath 20 is heated to a predetermined temperature so a part of the steel sheet structure can be transformed from austenite to bainite. The composition and the temperature of the electroplating solution (P) are variable by whether the process is the GI process or the GA process. The composition of the electroplating solution (P) can be easily understood by a person skilled in the art so its detailed description will be omitted.

The hot dip galvanized steel sheet is annealed in the annealing furnace 30 connected to a rear part of the hot dip galvanizing bath 20. Therefore, the hot dip galvanized layer is dried to be tightly coated on the steel sheet surface. In this case, a part of the structure of the hot dip galvanized steel sheet is heated to be transformed into bainite.

The hot dip galvanized steel sheet drawn out of the annealing furnace 30 is quenched by the gas injected by the gas injector 40. Since the hot dip galvanized steel sheet is steeply cooled to be below the martensite transformation temperature, the steel sheet is transformed into martensite. Therefore, the hot dip galvanized steel sheet with the hot dip galvanized layer formed on the steel that is transformed into martensite to have the high strength characteristic can be manufactured.

The present invention will be described in further detail through experimental examples which exemplify the embodiment of the present invention, but the embodiments of the present invention is not restricted thereto.

EXPERIMENTAL EXAMPLES

The hot dip galvanization process is simulated by using steel having the above-noted composition range. In Experimental Examples 1 to 4, the hot dip galvanizing process is simulated by using a salt bath. In Experimental Examples 5 and 6, the hot dip galvanizing process is simulated by using the multi-purpose annealing simulator (MultiPAS) testing device by Vatron. Also, in Experimental Examples 7 and 8, the hot dip galvanizing process is simulated by using the Rhesca galvanizing simulator.

Experimental Example 1

A sample including C of 0.15 wt %, MN of 2.0 wt %, Si of 0.3 wt %, Al of 0.03 wt %, Cr of 0.3 wt %, Mo of 0.3 wt %, N of 30 ppm, B of 30 ppm, an impurity, and the remainder of Fe is prepared. The sample is dipped into a salt bath heated at 870° C. for one minute. The sample heated at 870° C. is dipped into a salt bath heated at 460° C. for 10 seconds. The dipped sample is drawn out, cooled with water, and then quenched. That is, the GI process is simulated in Experimental Example 1. Other detailed process conditions will not be described since they are easily understood by a skilled person in the art.

Experimental Example 2

A sample having the same composition as Experimental Example 1 is prepared. The sample is dipped into a salt bath heated at 870° C. and left in it for one minute. The sample heated at 870° C. is dipped into a salt bath at 460° C. for 10 seconds. The dipped sample is drawn out, dipped 20 seconds into a salt bath at 500° C., is drawn out a, and is cooled with water to reach room temperature. That is, the GA process is simulated in Experimental Example 1. Detailed process conditions will not be described since they are easily understood by a skilled person in the art.

Experimental Example 3

A sample with the same composition as Experimental Example 1 is dipped into a salt bath heated at 830° C. for one minute. Other process conditions correspond to Experimental Example 1.

Experimental Example 4

A sample with the same composition as Experimental Example 1 is dipped into a salt bath heated at 830° C. for one minute. Other process conditions correspond to Experimental Example 2.

Experimental Example 5

A sample with the same composition as Experimental Example 1 is prepared. The sample is heated to reach 870° C. at a heating rate of 10° C./s from room temperature by using a resistive heating method. The sample is maintained at 870° C. for one minute and is then cooled to 460° C. at a cooling rate of 30° C./s by using compressed air. The steel sheet is maintained at 460° C. for ten seconds, and is then cooled to reach room temperature at the rate of 30° C./s by using compressed air. Other detailed process conditions will not be described since they are easily understood by a skilled person in the art.

Experimental Example 6

A sample with the same composition as Experimental Example 1 is prepared. The sample is heated to 870° C. at a heating rate of 10° C./s from room temperature by using a resistance heating method. The sample is maintained at 870° C. for one minute, and is then cooled to 460° C. at a cooling rate of 30° C./s by using compressed air. The steel sheet is maintained at 460° C. for ten seconds, and the steel sheet is resistance heated to reach 500° C. at a heating rate of 30° C./s. The steel sheet is maintained at 500° C. for 20 seconds, and is cooled at a cooling rate of 30° C./s to reach room temperature by using compressed air. Other detailed process conditions will not be described since they are easily understood by a skilled person in the art.

Experimental Example 7

A sample with the same composition as Experimental Example 1 is prepared. The sample is inductively heated from room temperature at a heating rate of 2.6° C./s to reach 850° C. The sample is maintained at 850° C. for 53 seconds. In this case, the gas atmosphere in the furnace includes a mixed gas of 10% $H_2$ and 90% $N_2$ of which the dew point is −35° C. The sample is maintained at 850° C. for 53 seconds, and compressed air is applied to cool the sample to reach 480° C. at a cooling rate of 14.2° C./s. When the sample has reached 480° C., the sample is dipped into a hot dip galvanizing bath maintained at 460° C. without using compressed air. The hot dip galvanizing bath includes 0.13 wt % of Al. The sample is dipped in the hot dip galvanizing bath at a temperature of 460° C. for 3.4 seconds, and is forcibly cooled with air to reach room temperature. Other detailed process conditions will not be described since they are easily understood by a skilled person in the art.

Experimental Example 8

A sample with the same composition as Experimental Example 1 is prepared. The experimental conditions except the dipping the steel sheet into the hot dip galvanizing bath including 0.2 wt % of Al are the same as the described Experimental Example 7.

Comparative Example 1

A sample with the same composition as Experimental Example 1 is prepared. The sample does not undergo the hot dip galvanizing process, that is, the process for dipping the sample into the salt bath, differing from the described Experimental Examples 1 to 4. That is, the sample is heated until it reaches 870° C., and is then maintained for one minute. The heated sample is cooled with water to cool it to reach room temperature.

Comparative Example 2

Comparative Example 2 is the same as Comparative Example 1 except that the sample is heated until it reaches 830° C.

Comparative Example 3

A sample with the same composition as Experimental Example 1 is prepared. The sample does not undergo the hot dip galvanizing process, that is, the process for maintaining the sample at 460° C., differing from the described Experimental Example 5 or 6. The sample is heated to reach 870° C. from room temperature at a rate of 10° C./s by using a resistance heating method. The steel sheet is maintained at 870° C. for one minute, and is then cooled to reach room temperature at a rate of 30° C./s by using compressed air.

Comparative Example 4

A sample to which boron is not added is prepared. The composition except for the boron is the same as Experimental Example 1. The sample is manufactured by using the same process as Experimental Example 1.

Comparative Example 5

A sample to which boron is not added is prepared. The composition except for the boron is the same as Experimental Example 1. The sample is manufactured by using the same process as Experimental Example 3.

Comparative Example 6

A sample to which boron is not added is prepared. The composition except for the boron is the same as Experimental Example 1. The sample is manufactured by using the same process as Experimental Example 2.

Comparative Example 7

A sample to which boron is not added is prepared. The composition except for boron is the same as Experimental Example 1. The sample is manufactured by using the same process as Experimental Example 5.

Comparative Example 8

A sample to which boron is not added is prepared. The composition except for the boron is the same as Experimental Example 1. The sample is manufactured by using the same process as Experimental Example 6.

Comparative Example 9

A sample to which boron is not added is prepared. The composition except for the boron is the same as Experimental Example 1. The sample is manufactured by using the same process as Comparative Example 3.

Comparative Example 10

A sample to which chromium (Cr) and molybdenum (Mo) are not added is prepared. The compositions except for the chromium (Cr) and molybdenum (Mo) correspond to Experimental Example 1. The sample is manufactured by using the same process as Experimental Example 5.

Comparative Example 11

A sample to which chromium (Cr) and molybdenum (Mo) are not added is prepared. The compositions except for the chromium (Cr) and molybdenum (Mo) correspond to Experimental Example 1. The sample is manufactured by using the same process as Experimental Example 6.

Comparative Example 12

A sample to which chromium (Cr) and molybdenum (Mo) are not added is prepared. The compositions except for the chromium (Cr) and molybdenum (Mo) correspond to Experimental Example 1. The sample is manufactured by using the same process as Experimental Example 3.

Test Results

Figure 4:
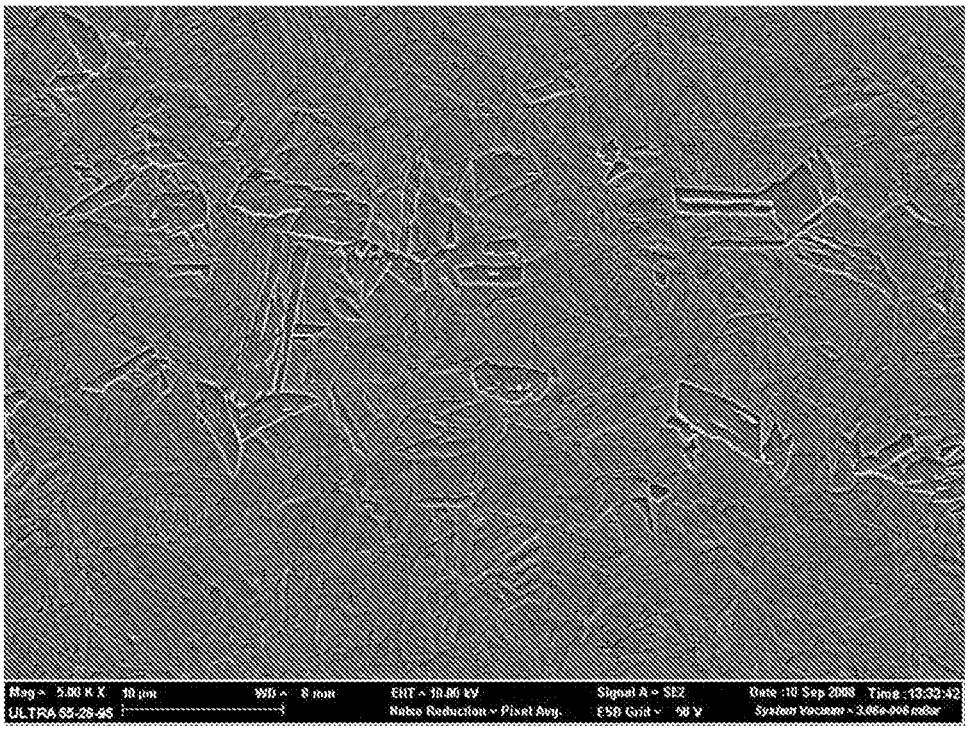
FIG. 4 to FIG. 7 show photographs of samples manufactured according to Experimental Examples 1 to 4 taken by a scanning electron microscope.
Figure 5:
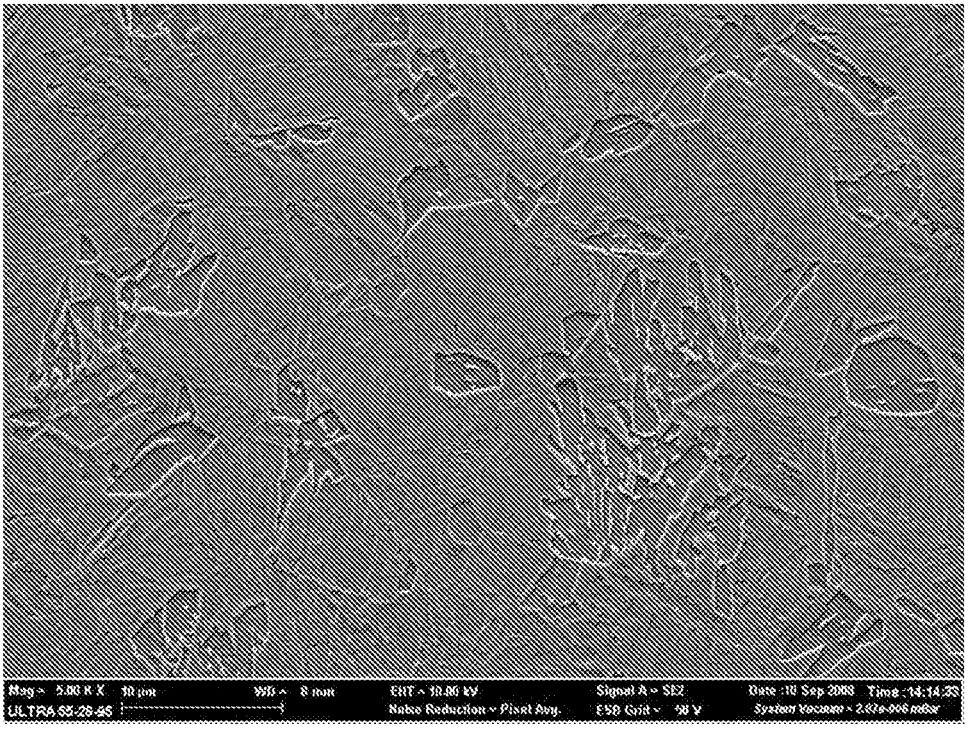
Figure 6:
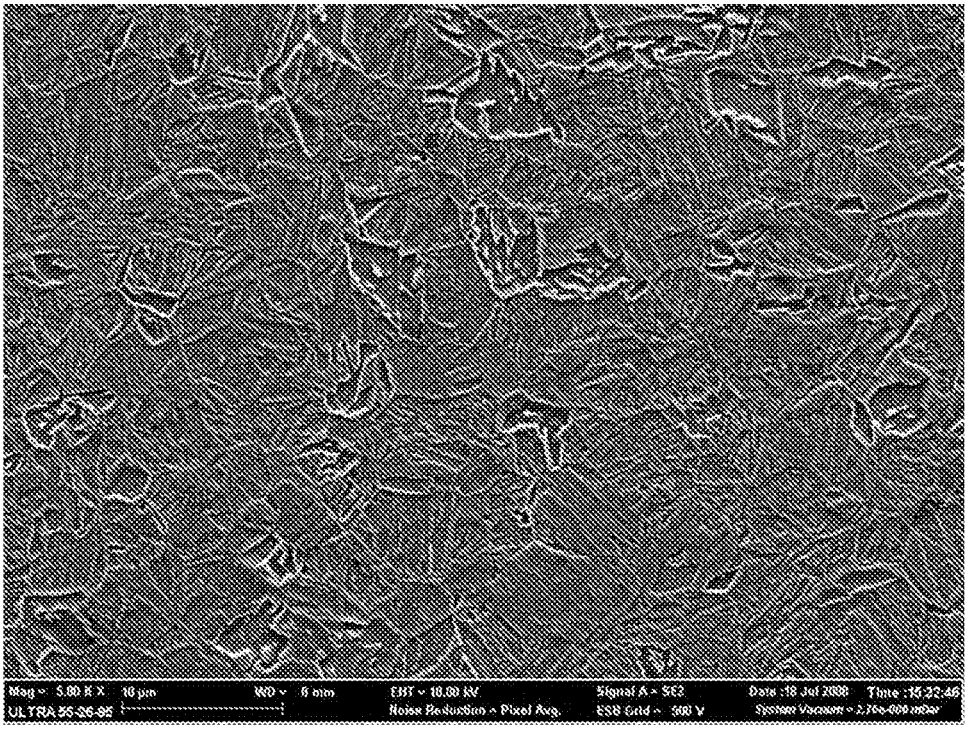
Figure 7:
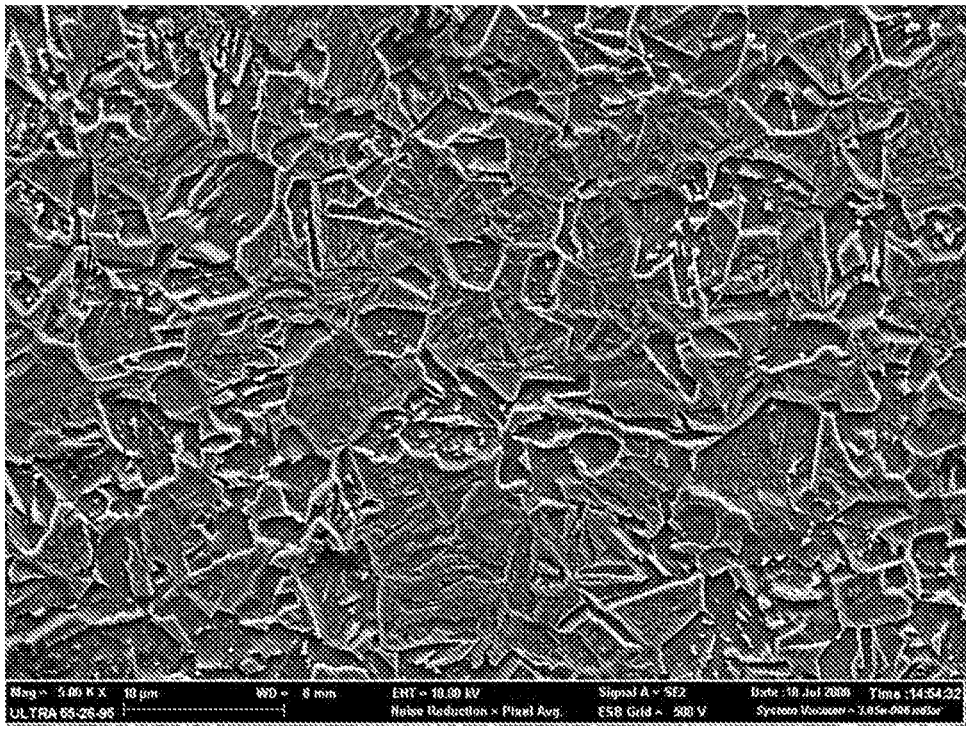
Figure 8:
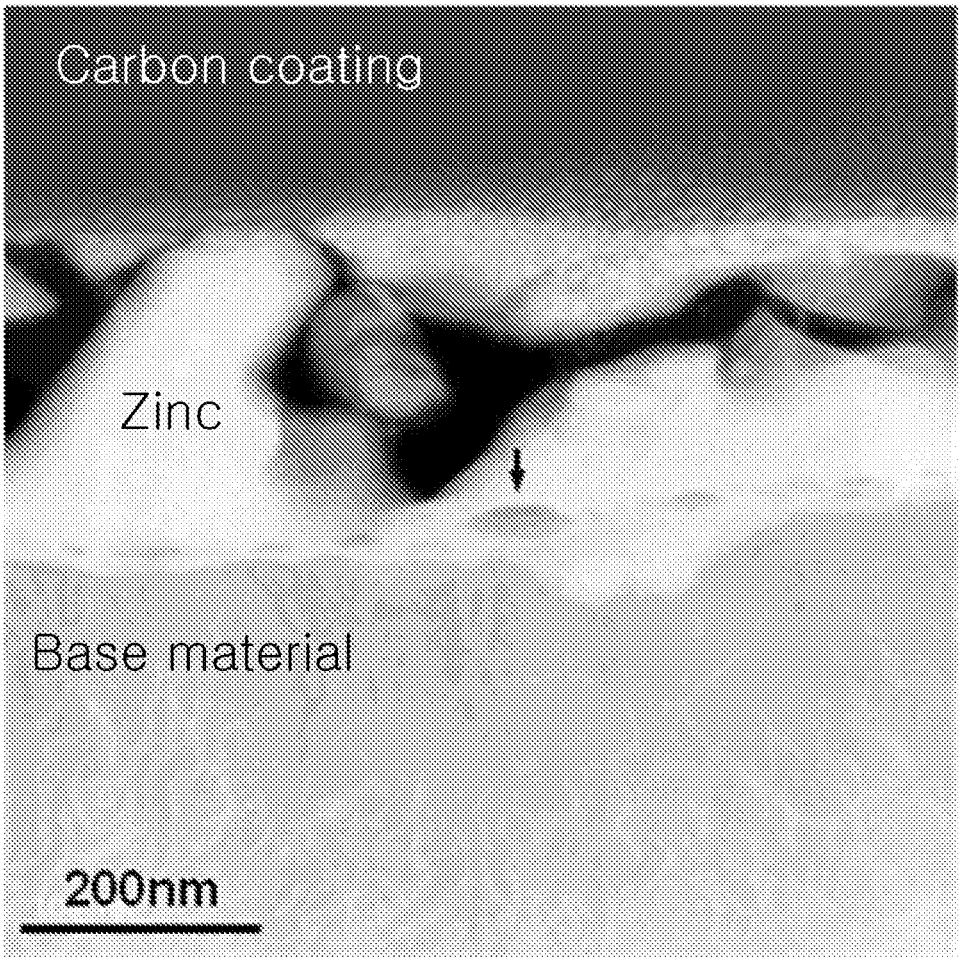
FIG. 8 and FIG. 9 show photographs of samples manufactured according to Experimental Examples 7 and 8 taken by a transmission electron microscope.
Figure 9:
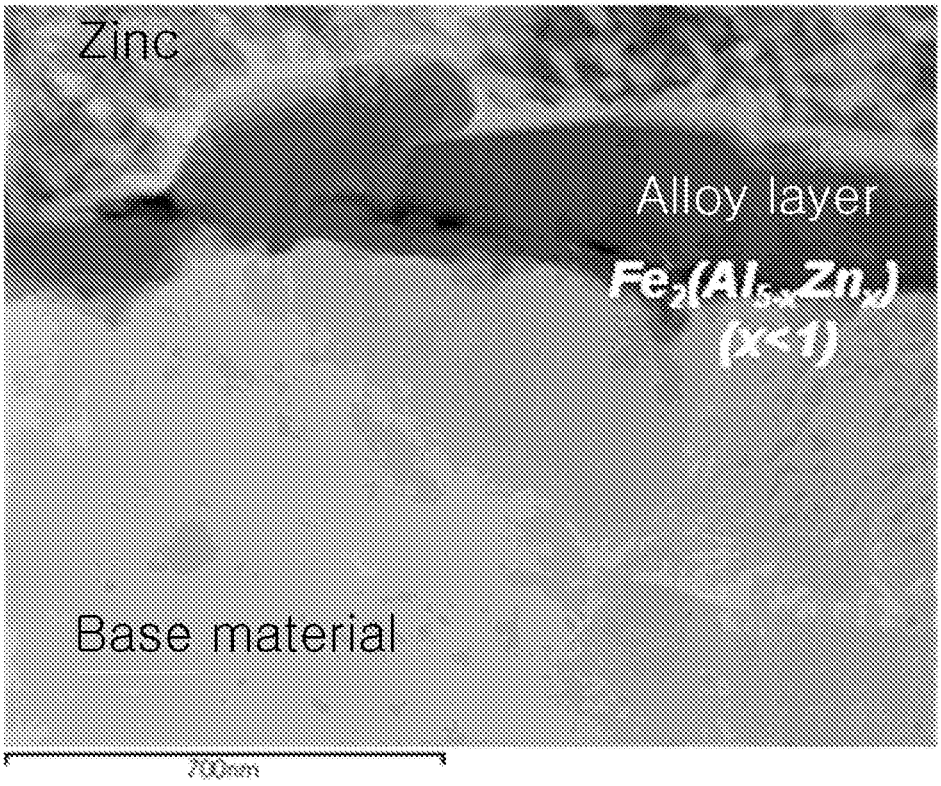
Figure 10:
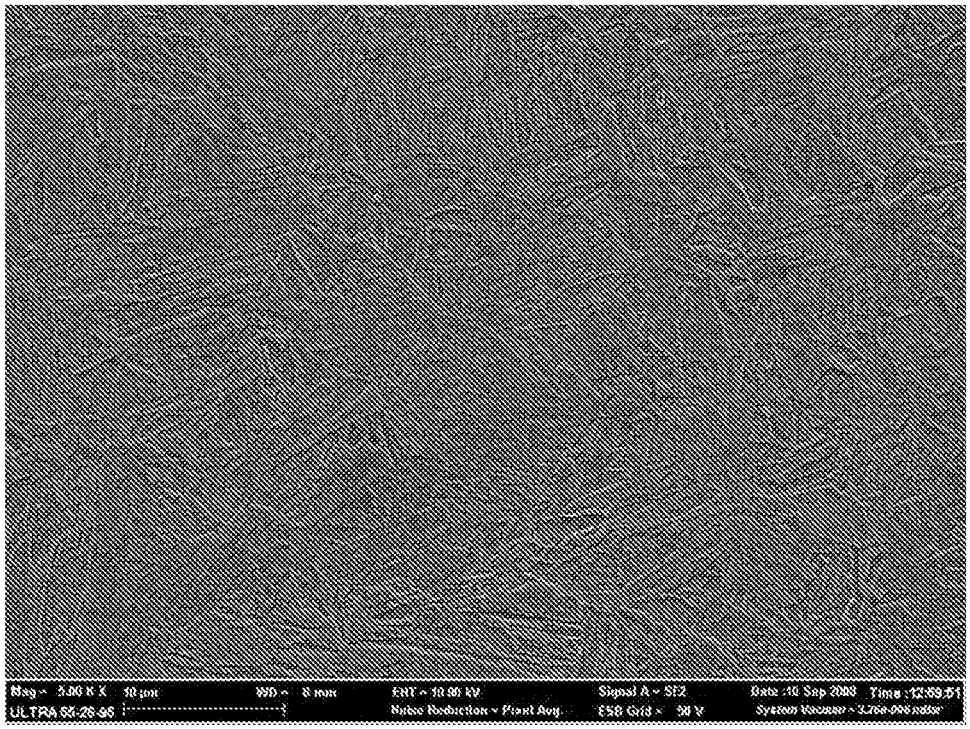
FIG. 10 and FIG. 11 show photographs of samples manufactured according to Comparative Examples 1 and 2 taken by a scanning electron microscope, respectively.
Figure 11:
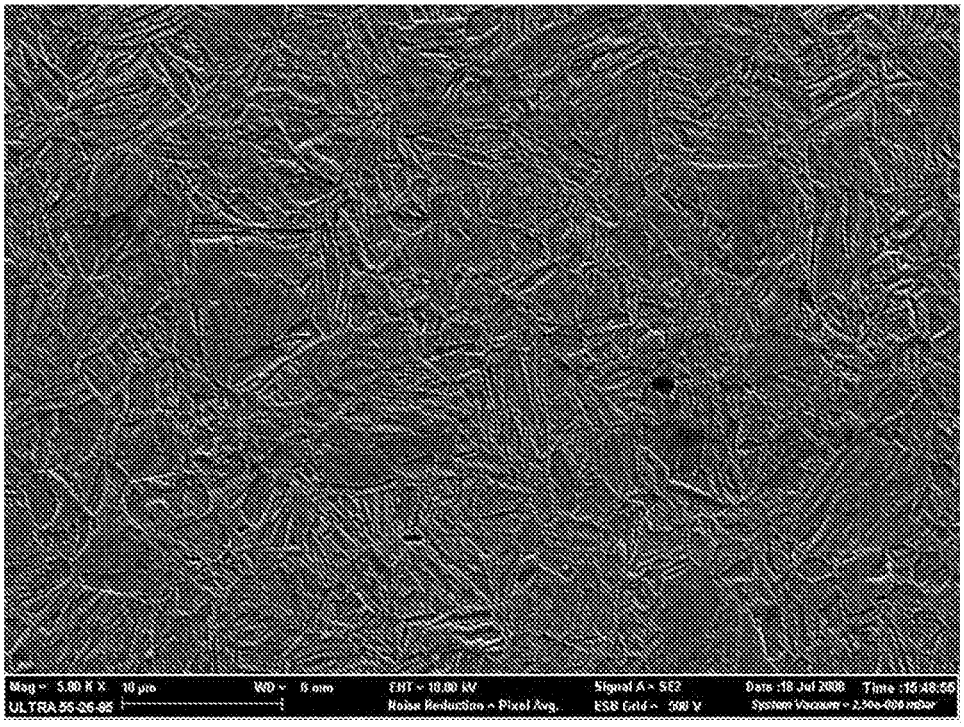
Figure 12:
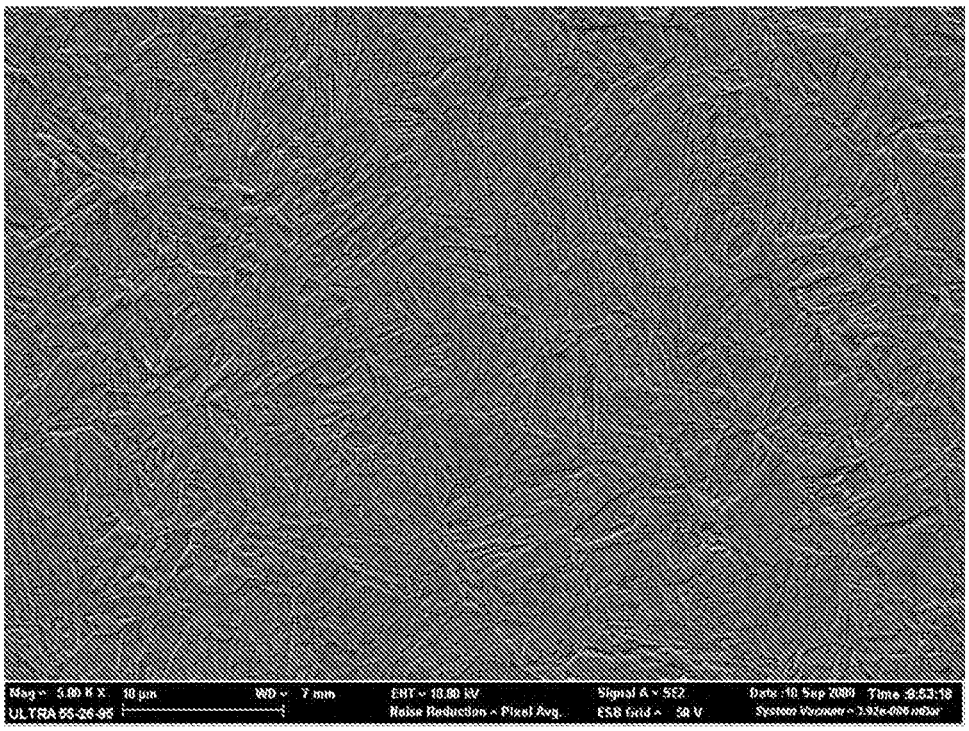
FIG. 12 to FIG. 14 show photographs of samples manufactured according to Comparative Examples 4 to 6 taken by a scanning electron microscope.
Figure 13:
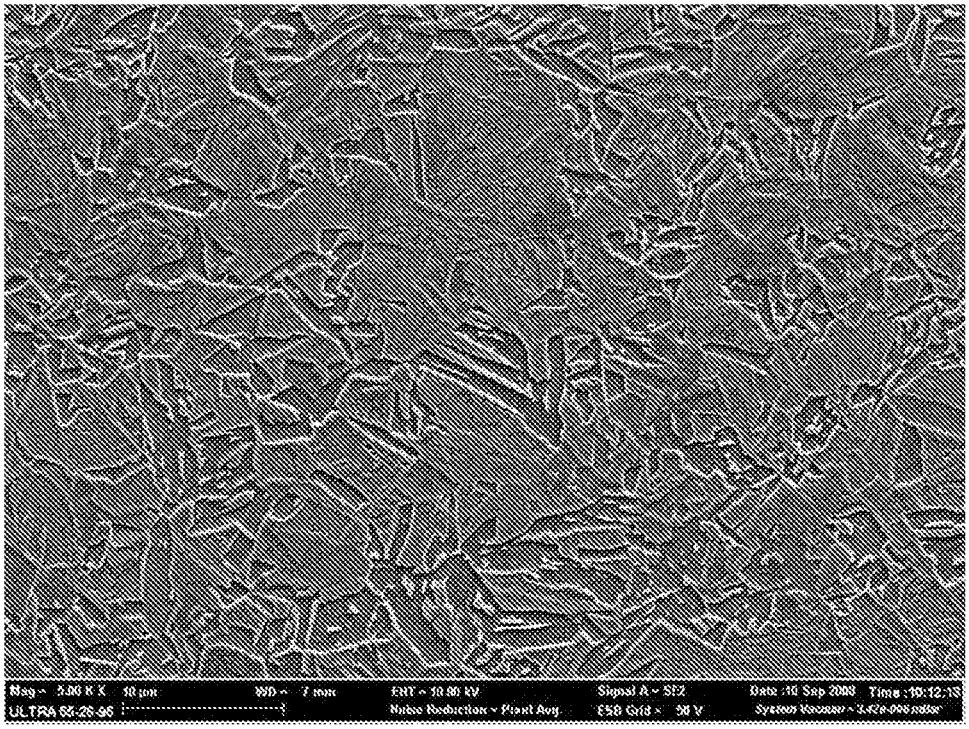
Figure 14:
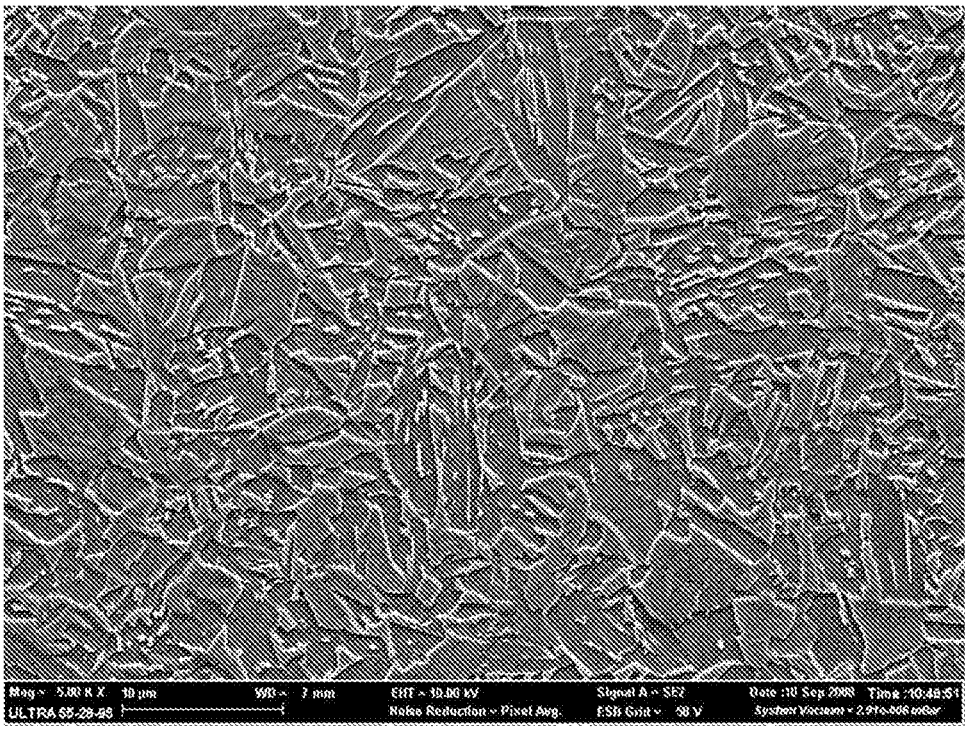

Photograph of the Sample's Structure Observed Through a Scanning Electron Microscope FIG. 4 to FIG. 14 respectively show photographs of the samples of Experimental Examples 1 to 4, Experimental Examples 7 and 8, Comparative Examples 1 and 2, and Comparative Examples 4 to 6 taken by the scanning electron microscope. That is, FIG. 4 shows a photograph of the sample according to Experimental Example 1 taken by the scanning electron microscope, FIG. 5 shows a photograph of the sample according to Experimental Example 2 taken by the scanning electron microscope, shows a photograph of the sample according to Experimental Example 3 taken by the scanning electron microscope, FIG. 7 shows a photograph of the sample according to Experimental Example 4 taken by the scanning electron microscope, FIG. 8 shows a photograph of the sample according to Experimental Example 7 taken by the scanning electron microscope, and FIG. 9 shows a photograph of the sample according to Experimental Example 8 taken by the scanning electron microscope. FIG. 10 shows a photograph of the sample according to Comparative Example 1 taken by the scanning electron microscope, FIG. 11 shows a photograph of the sample according to Comparative Example 2 taken by the scanning electron microscope, FIG. 12 shows a photograph of the sample according to Comparative Example 4 taken by the scanning electron microscope, FIG. 13 shows a photograph of the sample according to Comparative Example 5 taken by the scanning electron microscope, and FIG. 14 shows a photograph of the sample according to Comparative example 6 taken by the scanning electron microscope.

Photographs of the Samples According to Experimental Examples 1 and 2 Taken by the Scanning Electron Microscope As shown in FIG. 4 and FIG. 5, martensitic structures formed on the sample are observed in Experimental Examples 1 and 2, respectively. Some bainites are partly observed between minute martensitic structures. The bainite fraction of Experimental Example 1 is less than 3%, and the bainite fraction of Experimental Example 2 is substantially 10%. The martensite matrix has bainite so the bainite is assumed to be globular, and the fractions are substantially 3% and 10% in the 3-dimensional manner. The bainite fraction is high in Experimental Example 2 because it is dipped at 460° C. for ten seconds and is additionally dipped at 500° C. for 20 seconds. Therefore, bainite is additionally formed in the alloying simulation process.

Photographs of the Samples According to Experimental Examples 3 and 4 Taken by the Scanning Electron Microscope As shown in FIG. 6 and FIG. 7, the martensitic structures formed on the samples are observed in Experimental Examples 3 and 4. Some bainite and ferrite structures are partly observed between the minute martensitic structures. The sum of the fraction of bainite and ferrite according to Experimental Example 3 is less than 11%, which is greater than the bainite fraction according to Experimental Example 1. Also, the sum of the fractions of bainite and ferrite in Experimental Example 4 is 28%, which is greater than the bainite fraction of Experimental Example 2 because the temperature of 830° C. represents the ideal region in which ferrite and austenite coexist and the 3% of ferrite is included before it is dipped. That is, more bainite is generated compared to the case in which no ferrite exists on the parent phase because of the existence of ferrite during dipping.

The martensite and bainite structures generated in Experimental Examples 3 and 4 are further minute than the martensite and bainite structures generated in Experimental Examples 1 and 2. In the case of martensite and bainite transformation, the size of the generated martensite and bainite cannot be greater than the size of austenite, a parent phase. Therefore, since the size of the austenite at 830° C. is less than the size of austenite at 870° C., the size of the martensite and bainite after they are transformed is reduced.

Photograph of the Sample According to Experimental Example 7 Taken by the Transmission Electron Microscope FIG. 8 shows a cross-sectional structure of the sample manufactured according to Experimental Example 7. That is, FIG. 8 shows a boundary between a base material and a coating layer by cutting the sample manufactured according to Experimental Example 7.

As shown in FIG. 8, when the sample is dipped in the galvanizing bath including 0.13 wt % of Al, it is determined whether oxides with minute particles are included in the galvanized layer. The oxides are formed when the sample is maintained at 850° C. The oxides include a Mn group oxide and a SiO group oxide. When a coarse oxide is provided on the surface of the sample or forms a sequential layer, it substantially deteriorates wetness of the sample. However, as shown in FIG. 8, the composition of the sample used in Experimental Example 7 has a very much lesser amount of generated oxide which is discontinuously distributed so the area for the hot dip galvanizing bath to contact the sample and react to it is sufficiently acquired. Therefore, the hot dip zinc alloyed sample is manufactured by alloying the plated layer in the subsequent alloying process.

Photograph of the Sample According to Experimental Example 8 Taken by the Transmission Electron Microscope FIG. 9 shows a cross-sectional structure of the sample manufactured according to Experimental Example 8. That is, FIG. 9 shows a boundary between the base material and the coating layer by cutting the sample manufactured according to Experimental Example 8.

As shown in FIG. 9, the oxides including minute particles that are dipped in the galvanizing bath including 0.2 wt % of Al is included in the alloy layer. The alloy layer includes $Fe_2Al_5$. The alloy layer increases the adhesiveness between the base material and the plated layer. The amount of oxide that is generated when the sample is maintained at 850° C. is very much less and is discontinuously distributed. Therefore, the oxide existing on the surface of the sample does not hinder generation of the alloy layer when the sample is dipped into the hot dip galvanizing bath. Therefore, a hot dip galvanized sample with excellent wetness is manufactured.

Photograph of the Samples According to Comparative Examples 1 and 2 Taken by the Scanning Electron Microscope As shown in FIG. 10, the structure included in Comparative Example 1 is martensite, and the bainite or ferrite structure is not included because the steel sheet structure is changed into austenite at a temperature of 870° C. and is then transformed into martensite in the subsequent cooling process. The average size of the austenite graiN of the temperature of 870° C. is 10 μm.

As shown in FIG. 11, the structure included in Comparative Example 2 has martensite as a matrix structure, and includes 3% of ferrite because austenite and ferrite coexist at a temperature of 870° C. and the ferrite existing at the temperature of 870° C. is not influenced by the subsequent cooling process and remains in the structure. The average grain size of the austenite at the temperature of 870° C. is 7 μm.

Photograph of the Sample According to Comparative Example 4 Taken by the Scanning Electron Microscope As shown in FIG. 12, the structure included in Comparative Example 4 is martensite outwardly because it is transformed into martensite, while it includes no boron when it is cooled with water to reach room temperature from the temperature of 870° C. since the cooling rate is high.

Photograph of the Sample According to Comparative Example 5 Taken by the Scanning Electron Microscope As shown in FIG. 13, the structure in Comparative Example 5 includes martensite and bainite. Since no bainite transformation occurs during the cooling process with water, the bainite shown in the structure of FIG. 13 is generated during the dipping at 460° C. Also, the amount of bainite generated at the temperature is greater than the amount of bainite according to Comparative Example 1 so generation of bainite is suppressed during the boron cooling process and at the time of transformation of the maintained temperature.

Photograph of the Sample According to Comparative Example 6 Taken by the Scanning Electron Microscope As shown in FIG. 14, the structure included in Comparative Example 6 includes martensite and bainite. The fraction of bainite is increased compared to the case of Comparative Example 5, so when it is dipped for 20 seconds at 500° C. to be alloyed, bainite is additionally generated.

Tensile Strength Measured Results

The samples according to the above-described Experimental Examples 1 to 4 and Comparative Examples 1 and 2 are processed according to the ASTM E-8 standard while setting the cold rolling direction to be parallel with the tensile axis and a tensile test is performed with the transformation rate of 0.001/s.

Figure 15:
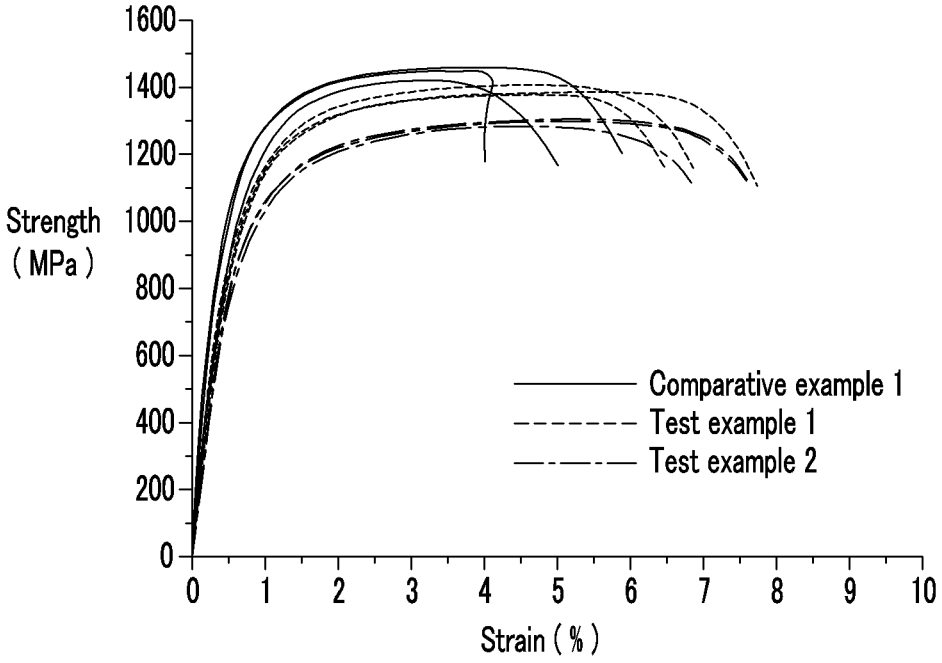
FIG. 15 shows a graph of tensile strength of a sample manufactured according to Experimental Examples 1 and 2 and Comparative Example 1.
Figure 16:
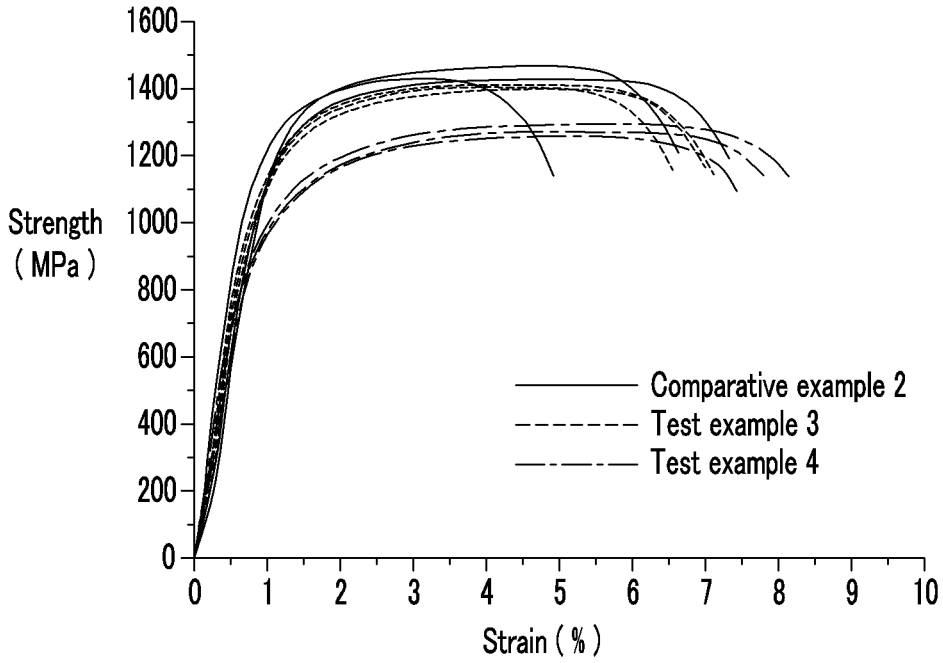
FIG. 16 shows a graph of tensile strength of a sample manufactured according to Experimental Examples 3 and 4 and Comparative Example 2.
Figure 17:
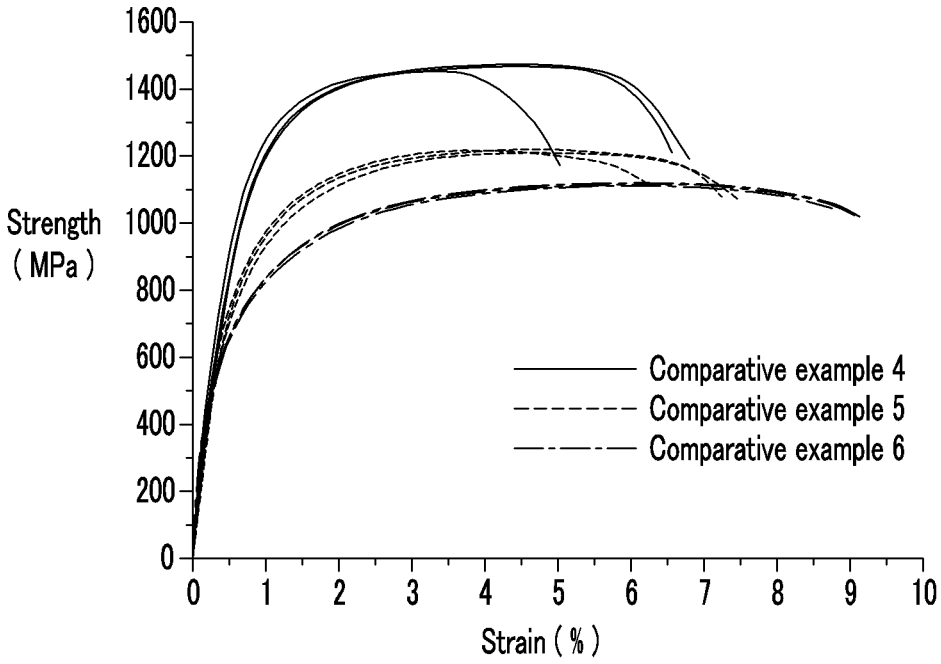
FIG. 17 shows a graph of tensile strength of samples manufactured according to Comparative Examples 4 to 6.

FIG. 15 shows a graph of tensile strength of a sample manufactured according to Experimental Examples 1 and 2 and Comparative Example 1, and FIG. 16 shows a graph of tensile strength of a sample manufactured according to Experimental Examples 3 and 4 and Comparative Example 2. FIG. 17 shows a graph of tensile strength of samples manufactured according to Comparative Examples 4 to 6.

Tensile Strength of the Samples according to Experimental Examples 1 and 2 and Comparative Example 1

FIG. 15 shows the tensile strength of the samples according to Experimental Examples 1 and 2 and Comparative Example 1 measured three times, respectively. Experimental Example 1 is shown with dotted lines, Experimental Example 2 is shown with one-point chain lines, and Comparative Example 1 is shown with solid lines.

As shown in FIG. 15, the ultimate tensile strength (UTS) of the sample in Experimental Example 1 is substantially 1400 MPa. Also, the ultimate tensile strength (UTS) of the sample in Experimental Example 2 is substantially 1270 MPa. The ultimate tensile strength (UTS) of the sample in Comparative Example 1 is substantially 1470 MPa. As shown in FIG. 15, the strength of the sample of Comparative Example 1 is the best and is not much different from the strength of the samples of Experimental Examples 1 and 2. Therefore, it is found through Experimental Examples 1 and 2 that the strength of the martensite-transformed hot dip galvanized steel sheet is excellent.

Tensile Strength of the Samples According to Experimental Examples 3 and 4 and Comparative Example 2

FIG. 16 shows the tensile strength of the samples according to Experimental Examples 3 and 4 and Comparative Example 2 measured three times, respectively. Experimental Example 3 is shown with dotted lines, Experimental example 4 is shown with one-point chain lines, and Comparative Example 2 is shown with solid lines.

As shown in FIG. 16, the ultimate tensile strength (UTS) of the sample in Experimental Example 3 is substantially 1410 MPa. Also, the ultimate tensile strength (UTS) of the sample in Experimental Example 4 is substantially 1280 MPa. The ultimate tensile strength (UTS) of the sample in Comparative Example 2 is substantially 1480 MPa. As shown in FIG. 16, the strength of the sample of Comparative Example 2 is the best and is not much different from the strength of the samples of Experimental Examples 3 and 4. Therefore, it is found through Experimental Examples 3 and 4 that the strength of the martensite-transformed hot dip galvanized steel sheet is excellent. Further, the strength of the samples according to Experimental Examples 3 and 4 in FIG. 16 is somewhat greater than the strength of the samples according to Experimental Examples 1 and 2 in FIG. 15.

Tensile Strength of the Samples According to Comparative Examples 4 to 6

FIG. 17 shows the tensile strength of the samples according to Comparative Examples 4 to 6 measured three times, respectively. Comparative Example 4 is shown with solid lines, Comparative Example 5 is shown with dotted lines, and Comparative Example 6 is shown with one-point chain lines.

As shown in FIG. 17, the ultimate tensile strength (UTS) of the sample in Comparative Example 4 is substantially 1430 MPa. Also, the ultimate tensile strength (UTS) of the sample in Experimental Example 5 is substantially 1170 MPa. Further, the ultimate tensile strength (UTS) of the sample in Experimental Example 6 is substantially 1060 MPa.

As shown in FIG. 17, Comparative Examples 4 to 6 in which no boron is added to the sample generated lesser strength of the sample than the strength of the samples according to Experimental Examples 1 and 2 because the hot dip galvanizing simulation and the alloying hot dip galvanizing simulation show a further amount of transformed bainite compared to the case in which the boron is added. Therefore, it is found that the strength of the sample can be substantially improved by adding a small amount of boron to the sample.

Test Results of Ultimate Tensile Strength According to Experimental Examples 1 to 4 and Comparative Examples 1 and 2

Figure 18:
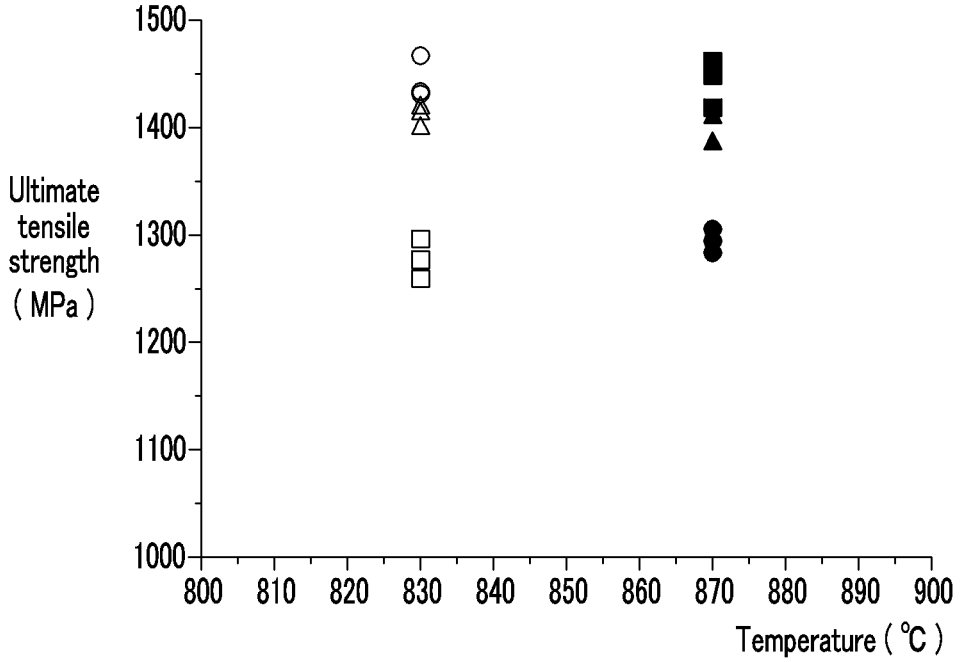
FIG. 18 shows a graph of ultimate tensile strength of samples manufactured according to Experimental Examples 1 to 4 and Comparative Examples 1 and 2.

FIG. 18 shows a graph of ultimate tensile strength of samples manufactured according to Experimental Examples 1 to 4 and Comparative Examples 1 and 2. The ultimate tensile strength of the samples is measured three times, respectively.

The quadrangle of the heating temperature of 870° C. in FIG. 18 shows Comparative Example 1, the triangle shows Experimental Example 1, and the circle shows Experimental Example 2. Also, the circle with the empty inner part at the heating temperature of 830° C. in FIG. 18 shows Comparative Example 2, the triangle with the empty inner part shows Experimental Example 3, and the quadrangle with the empty inner part shows Experimental Example 4.

As shown in FIG. 18, the ultimate tensile strength of the sample manufactured according to Experimental Example 1 is substantially 1400 MPa as an average, and the ultimate tensile strength of the sample manufactured according to Experimental Example 2 is substantially 1290 MPa as an average. The ultimate tensile strength of the sample manufactured according to Experimental Example 3 is substantially 1410 MPa as an average, and the ultimate tensile strength of the sample manufactured according to Experimental Example 4 is substantially 1280 MPa as an average. Further, the ultimate tensile strength of the sample manufactured according to Comparative Example 1 is substantially 1450 Mpa as an average, showing the same result as the case of the sample that is manufactured according to Comparative Example 2.

As shown in FIG. 18, the ultimate tensile strengths of the samples manufactured according to Experimental Examples 1 to 4 are less than the ultimate tensile strengths of the samples that are manufactured according to Comparative Examples 1 and 2 with a small difference. Therefore, a hot dip galvanized steel sheet with excellent strength can be manufactured through Experimental Examples 1 to 4.

Test Results of the Ultimate Tensile Strength According to Experimental Examples 5 and 6 and Comparative Examples 3 and 7 to 12

Figure 19:
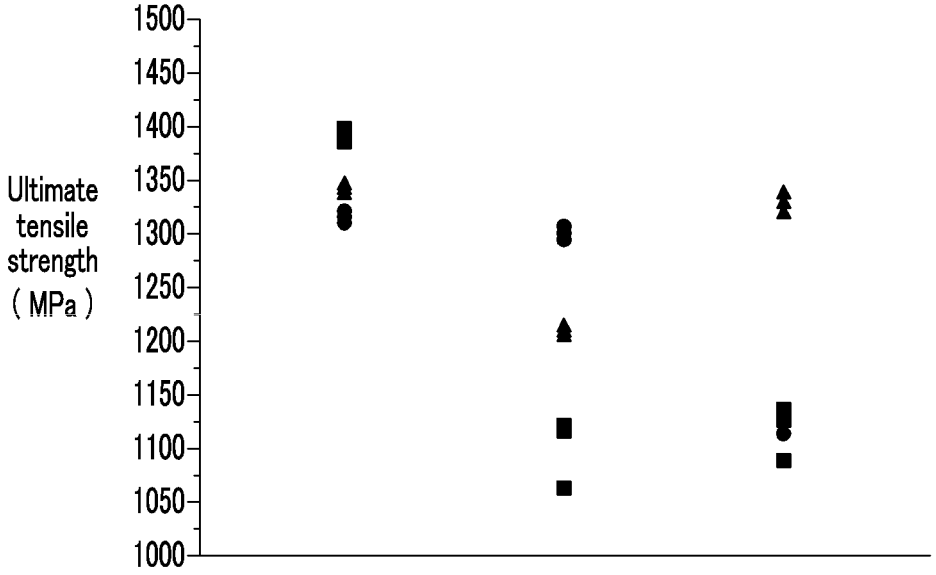
FIG. 19 shows a graph of ultimate tensile strength of samples manufactured according to Experimental Examples 5 and 6, Comparative Example 3, and Comparative Examples 7 to 12.

FIG. 19 shows a graph of ultimate tensile strength of samples manufactured according to Experimental Examples 5 and 6, Comparative Example 3, and Comparative Examples 7 to 12. The ultimate tensile strengths of the samples are measured four times respectively.

In the left column of FIG. 19, the quadrangle shows Comparative Example 3, the triangle shows Experimental Example 5, and the circle shows Experimental Example 6. In the middle column of FIG. 19, the circle shows Comparative Example 12, the triangle shows Comparative Example 11, and the quadrangle shows Comparative Example 10. In the right column of FIG. 19, the triangle shows Comparative Example 7, the circle shows Comparative Example 8, and the quadrangle shows Comparative Example 9.

FIG. 19 shows ultimate tensile strengths that are similar to the ultimate tensile strength of the steel sheet in the case of cooling with water when the cooling rate of the steel sheet is low and when boron, chromium, and molybdenum are included. When boron is not included and chromium and molybdenum are added, the ultimate tensile strength is reduced compared to the case of cooling with water, signifying that the bainite transformation is progressed in the case of slow cooling. Also, the ultimate tensile strengths of Comparative Example 5 and Comparative Example 6 are similar to each other. When the steel sheet is dipped at 460° C., austenite is changed into bainite so it is determined that there is no structure difference when the alloying process simulation is performed at 500° C.

When Comparative Example 3 and Comparative Example 12 are mutually compared, the solid solution hardening effect of chromium and molybdenum on martensite is found. When chromium and molybdenum are included in the steel sheet, the strength difference therebetween on martensite is shown to be 100 Mpa. Further, the strength difference is increased when the hot dip galvanizing process is simulated.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method for manufacturing an ultrahigh strength hot dip galvanized steel sheet, the method comprising:

providing a steel sheet including C of 0.05 wt % to 0.30 wt %, Mn of 0.5 wt % to 3.5 wt %, Si of 0.1 wt % to 0.8 wt %, Al of 0.01 wt % to 1.5 wt %, Cr of 0.01 wt % to 1.5 wt %, Mo of 0.01 wt %, to 1.5 wt %, Ti of 0.001 wt %, to 0.10 wt %, N of 5 ppm to 120 ppm, B of 29 ppm to 50 ppm, an impurity, and the remainder of Fe;

maintaining the steel sheet at a temperature in a range of 750° C. to 950° C. by heating to form an austenite microstructure;

dipping the heated steel sheet into a hot dip galvanizing bath to hot dip galvanize the steel sheet; and quenching the hot dip galvanized steel sheet at a quenching rate of 10° C./s to 100° C./s to transform the austenite microstructure to a martensite microstructure, wherein the martensite microstructure comprises greater than 60 vol % and less than 100 vol % of total microstructure in which a bainite structure comprises greater than 0 vol % and less than 40 vol %.

2. The method of claim 1, wherein:

in the providing of the steel sheet, an amount of C is 0.05 wt % to 0.20 wt %, an amount of Ti is 0.001 wt % to 0.05 wt %, and an amount of N is 20 ppm to 80 ppm;

in the maintaining of the temperature of the steel sheet, the temperature of the steel sheet is maintained at 780° C. to 950° C.; and in the quenching of the steel sheet, the quenching rate is 10° C./s to 60° C./s.

3. The method of claim 2, wherein in the providing of the steel sheet, an amount of C is 0.15 wt %, an amount of Mn is 2.0 wt %, an amount of Si is 0.3 wt %, an amount of Al is 0.03 wt %, an amount of Cr is 0.3 wt %, and an amount of Mo is 0.3 wt %.

4. The method of claim 1, wherein in the quenching of the steel sheet, the quenching rate is 10° C./s to 40° C./s.

5. The method of claim 4, wherein the quenching rate is 20° C./s to 40° C./s.

6. The method of claim 1, the hot dip galvanizing bath includes Fe.

* * * * *